United States Patent [19]

Kockler et al.

[11] Patent Number: 4,575,296

[45] Date of Patent: Mar. 11, 1986

[54] APPARATUS AND METHOD FOR PREPARING MULTIPAGE, SIDE-STITCHED DOCUMENTS

[75] Inventors: Barry C. Kockler, Lewisville; Daniel T. Noonan, Plano; Donald F. Renfrow, Richardson, all of Tex.

[73] Assignee: The Mead Corporation, Dayton, Ohio

[21] Appl. No.: 612,230

[22] Filed: May 21, 1984

[51] Int. Cl.[4] ..... B42B 4/02

[52] U.S. Cl. ..... 412/6; 270/53; 412/33

[58] Field of Search ..... 270/37, 53; 281/40; 412/6, 33, 36, 37, 8, 34

[56] References Cited

U.S. PATENT DOCUMENTS 4,196,835 4/1980 Schlough ..... 412/33 X 4,479,641 10/1984 Bean et al. ..... 270/53

4,507,036 3/1985 Rathert ..... 412/8 X

*Primary Examiner*—Paul A. Bell

*Attorney, Agent, or Firm*—Biebel, French & Nauman

[57] ABSTRACT

Apparatus is disclosed for preparing side-stitched documents. The apparatus includes means for feeding a series of sheets to be included in said document in a paused, timed, preselected order, a downstream, in-line accumulating station to receive the sheets, first clamping means associated with the accumulating station for grasping a complete assembly of sheets on the side opposite the side to be stitched, and means for moving said clamped assembly to a downstream, in-line stitching station. The stitching station includes a stitching head to make two or more stitches in the assembled sheets at selected loci along their edge, means for moving the stitched assembly downstream from the stitching station, stop means downstream of the stitching station to stop movement of the side-stitched document, second clamping means associated with said stop means for grasping the document on its upstream side transverse to the stitched side, means for releasing the first clamping means from the document and returning said clamping means to the accumulating station, and means for releasing the second clamping means and transferring the side-stitched, document to a packing station.

10 Claims, 7 Drawing Figures

FIG. 6
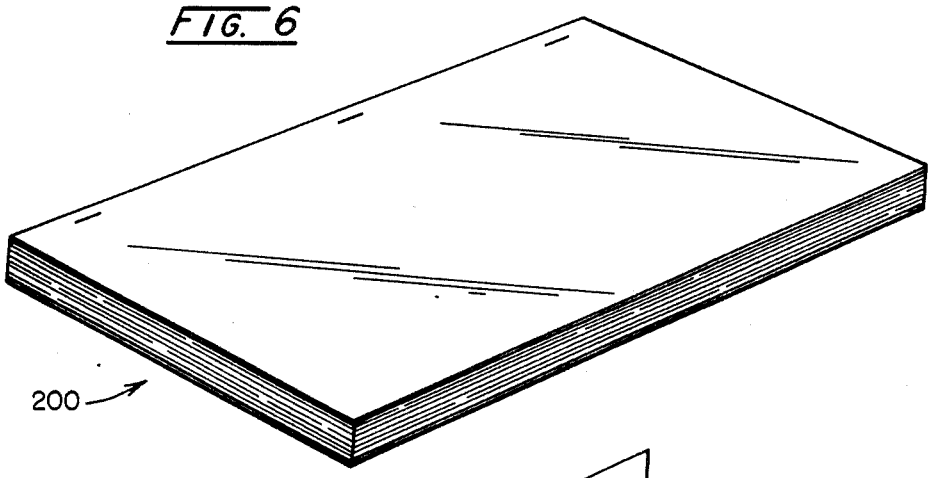
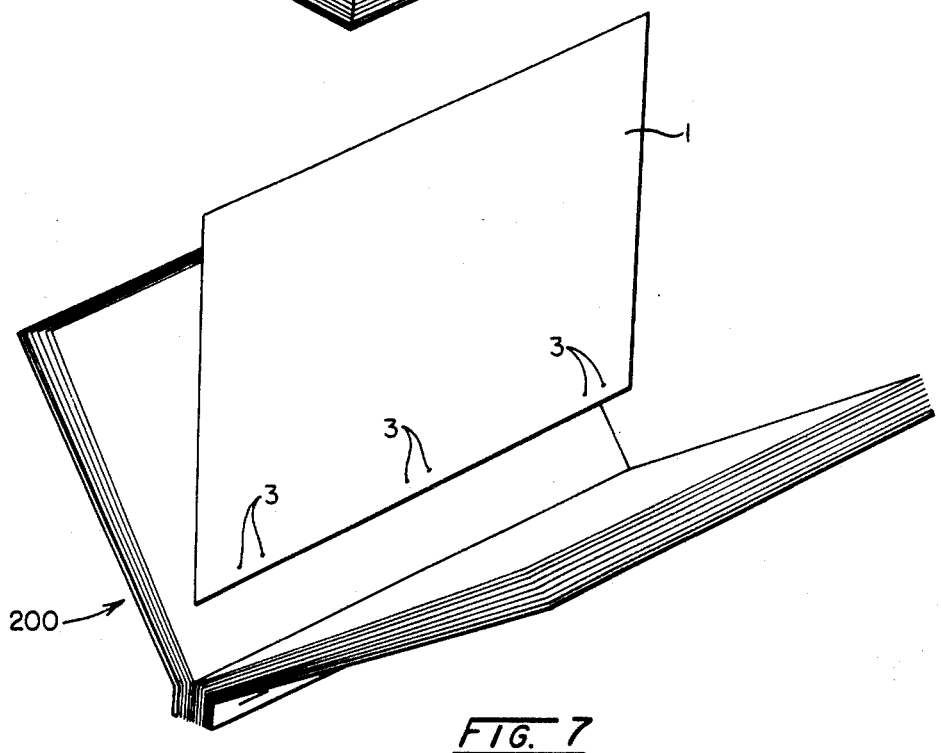
FIG. 7

APPARATUS AND METHOD FOR PREPARING MULTIPAGE, SIDE-STITCHED DOCUMENTS

BACKGROUND OF THE INVENTION

The present invention relates to apparatus useful for assembling printed sheets and the like into side-stitched documents such as reports and the like.

Organizations of many types such as research laboratories, sales departments and the like have frequent need to prepare documents such as reports for distribution. The advent of word processors, high-speed copiers and/or duplicators has materially reduced the cost of preparing such printed materials. The art of assembling the printed material into side-stitched documents has lagged, however, as the assembly and preparation of such documents is at best only partially automated. Accordingly, there is a need in the art for improved apparatus and methods for preparing side-stitched documents.

SUMMARY OF THE INVENTION

The invention is directed to apparatus and methods for preparing side-stitched documents. The apparatus includes accumulator means for receiving imaged sheets and collecting them in a stack, and means defining a stapling station displaced from the accumulator means in a direction parallel to one edge of the stack. The apparatus also includes means for transporting the stack from the accumulator means to the stapling station and clamping means for clamping the sheets together while being transported. The transport means causes portions of the stack to pass successively through the stapling station where the stapling means drives staples through different portions of the stack as they are presented to the stapling station.

BRIEF DESCRIPTION OF THE DRAWING

FIG. 6 is a perspective view of a multipage, side-stitched document prepared with the apparatus of the invention.

FIG. 7 is a view of the document of FIG. 6 laid open with one page shown in an exploded view to show the position of the stitch sites.

DETAILED DESCRIPTION OF THE INVENTION

Figure 1:
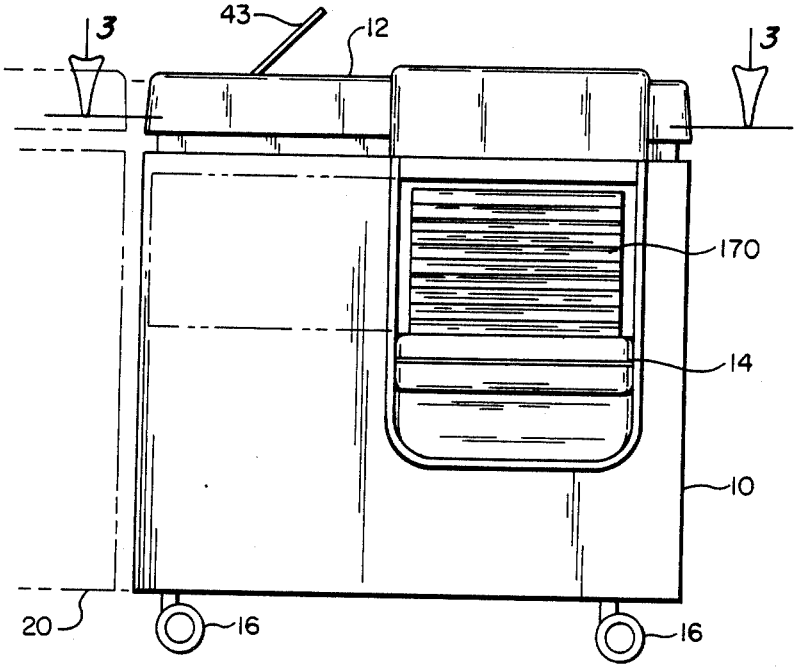
FIG. 1 is a front elevation of the apparatus of the invention.
Figure 2:
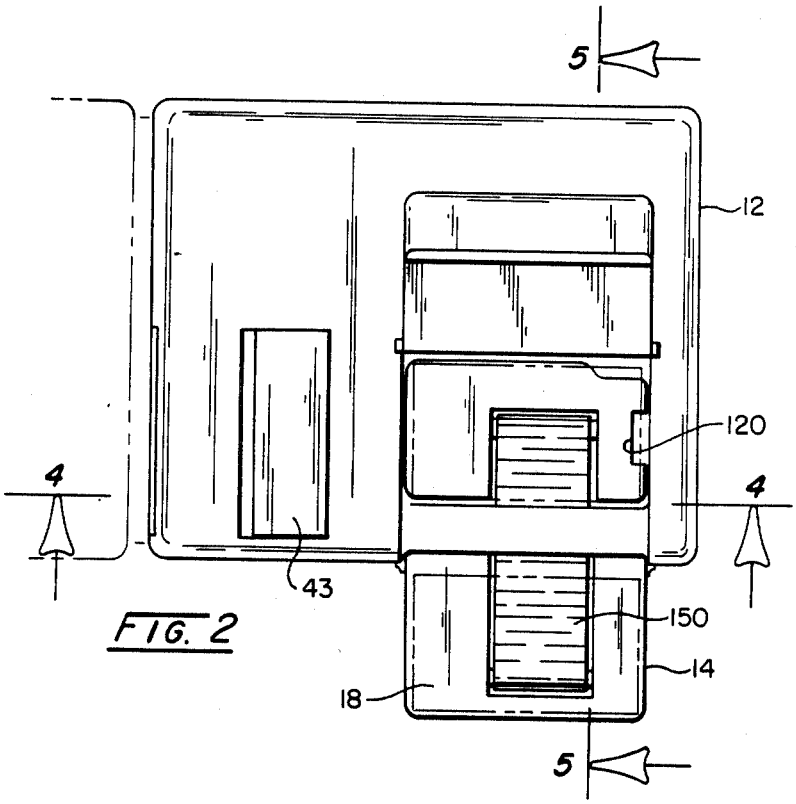
FIG. 2 is a top plan view of the apparatus shown in FIG. 1 with a cover opened.

Referring to the drawings, the functional elements to be subsequently described, including the page accumulating and storing means, the document transport means, the stitching means, the two clamping means, signal generating means such as a microrocessor and related hardware are housed in a cabinet 10 which has a removable top 12. A housing 14 is provided integrally with cabinet 10 to receive delivery of stacks of documents prepared by the apparatus. Wheels 16 are provided to facilitate easy movement of the apparatus.

Figure 3:
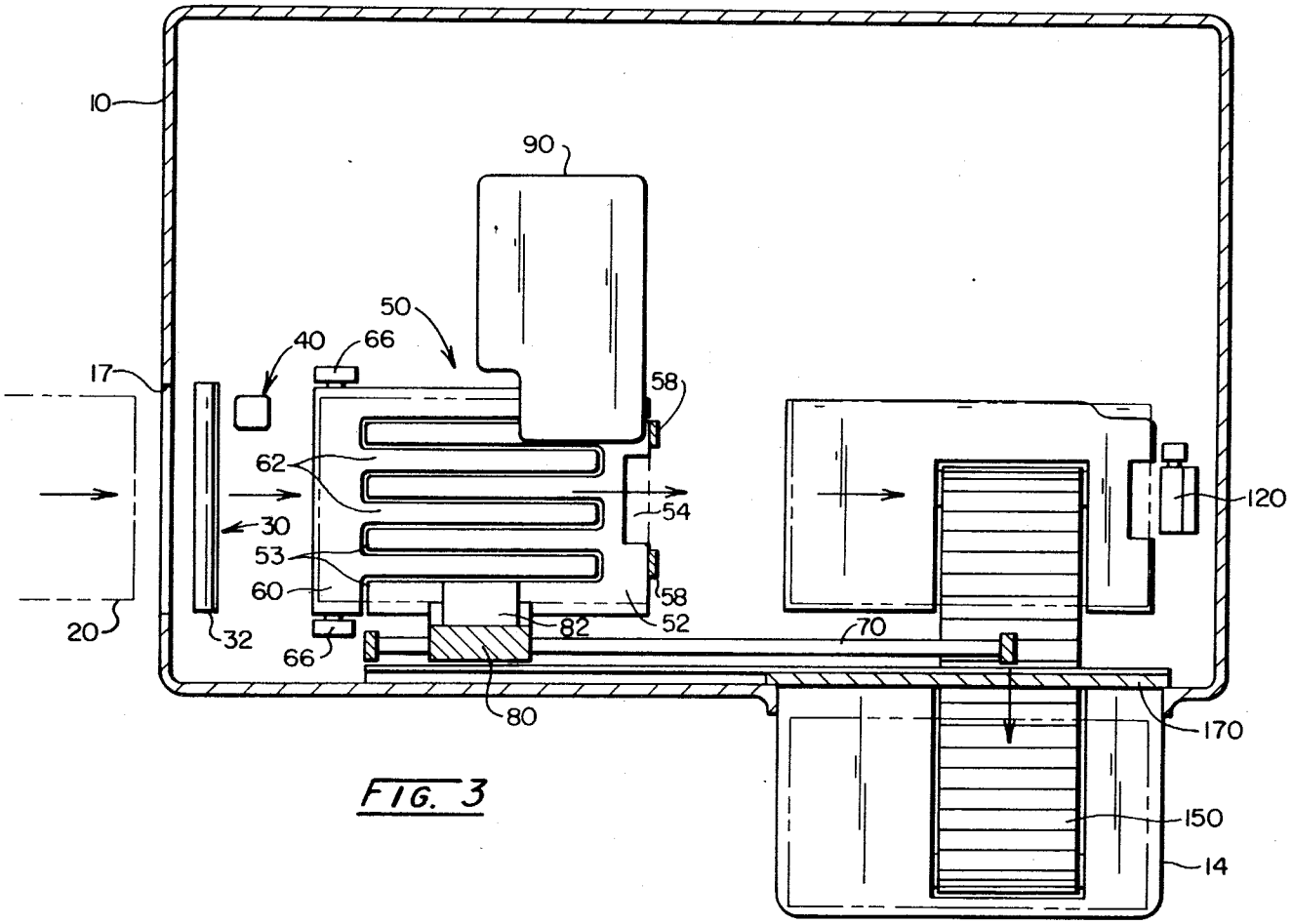
FIG. 3 is a schematic view, partially in section, taken through line 3—3 of FIG. 1.

Referring to FIG. 3., the apparatus includes aligned in the direction of sheet flow shown by the arrows:

1. external sheet feeding means, housed in a second cabinet 20, which feeds paper or like sheets in a preselected order into cabinet 10 through opening 17 provided therein;
2. internal sheet feeding means 30;
3. optional hole punching means 40;
4. An accumulator tray 50 which, in the preferred embodiment shown, consists of a transportable main body or car 52 and a split tray member 60, which is not transportable, but which can be raised to a second position to receive and accumulate sheets when the car 52 is moved out of its home position;
5. First clamping means 80 attached to the car 52 for securing accumulated sheets thereto when the car is being moved to and through downstream operation;
6. stitching means 90; and
7. stopping and second clamping means 120.

In operation of the apparatus, sheets 1, from a suitable source in cabinet 20, are fed by feeding means (not shown) in a preselected order, in a paused, timed sequence, through opening 17 into the apparatus of the invention housed in cabinet 10. As means for feeding sheets in a preselected order in a paused, timed sequence are known in the art and do not, per se, constitute an element of the present invention, these features are not shown in the drawings. The pauses provided between the feeding of the individual sheets 1 will not necessarily be constant between each pair of sheets, but will be controlled by signals from a preprogrammed control system such as a microprocessor (not shown).

Figure 4:
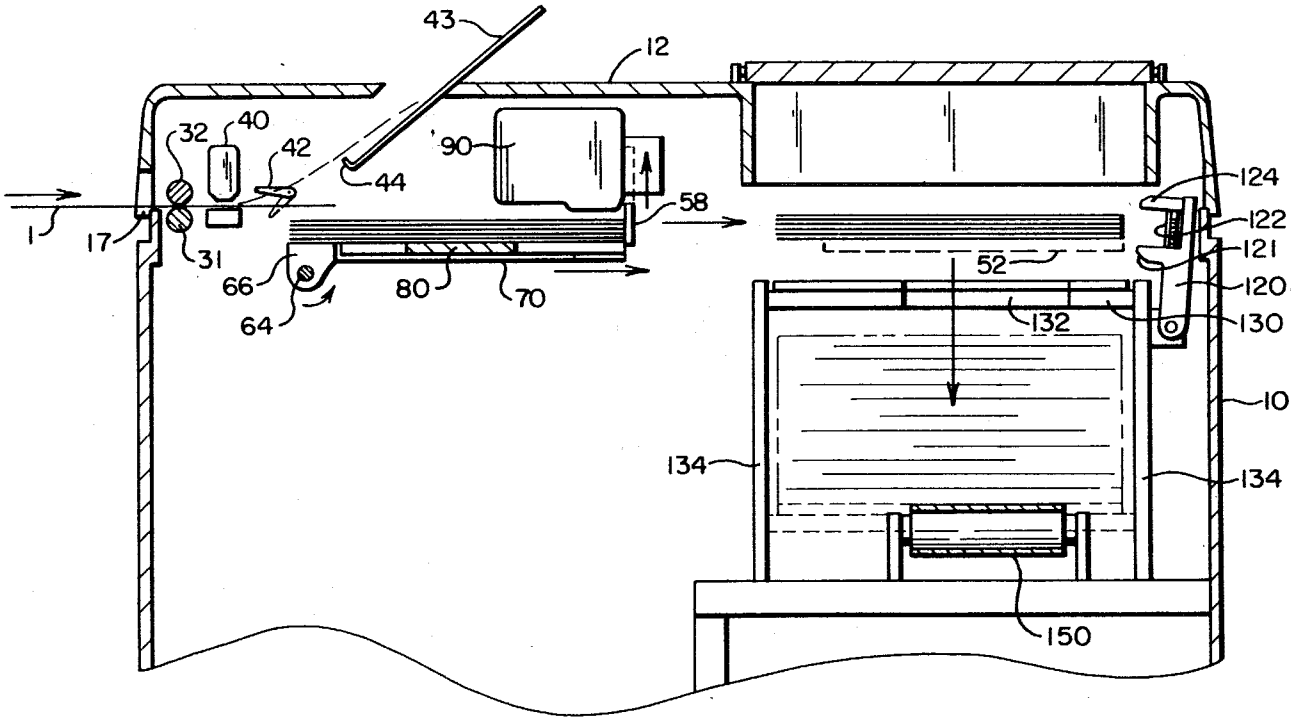
FIG. 4 is a schematic view, partially in section, taken through line 4—4 of FIG. 2.

In response to a signal from the microprocessor, a first sheet 1 to be included in a document 200 (see FIGS. 6 and 7) is fed to the apparatus of the invention through opening 17 of cabinet 10. This sheet first passes through internal sheet feeding means 30. As seen in FIG. 4, the sheet feeding means 30 includes a bottom roll 31 and a top roll 32. Roll 31 rotates in a clockwise direction and roll 32 rotates in a counterclockwise direction. The sheets 1 are driven by the action of rolls 31 and 32 into the accumulator tray 50 where they are stopped by stop elements 58. Accumulator tray 50 is a split tray which includes two principal elements. The first element is a transportable main body or car member 52 whose horizontal bottom includes rearwardly facing fingers 53. A recess 54 is cut in the front end of car member 52 for reasons subsequently discussed. The second element is a stationary elevatable member 60 which includes forwardly facing fingers 62. Car 52 rides on rails (not shown) which are aligned in the direction of sheet flow. The first clamping means 80 is mounted integrally on car 52 and rides on rails 70. A cable (not shown) is attached to clamping means 80 and in cooperation with a motor (not shown) moves car 52 in both directions along rails 70. As best seen in FIG. 4, the elevatable member 60 is supported on a rod 64 by brackets 66.

Figure 5:
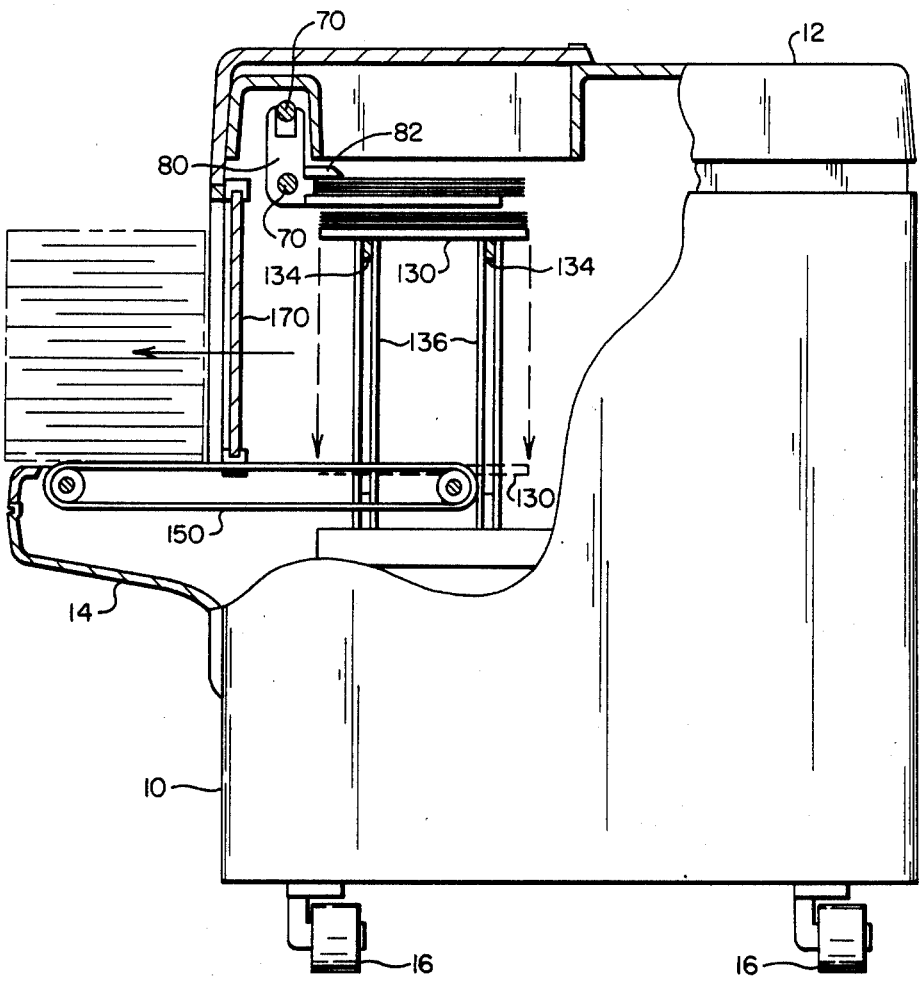
FIG. 5 is a schematic view, partially in section with parts broken away, taken through line 5—5 of FIG. 2.

When the last sheet to be included in document 200 has been fed into the accumulator tray 50, the microprocessor generates signals which cause several interrelated actions to take place. The feeding of sheets through opening 17 is temporarily stopped. The stop means 58 are raised to a second elevated position shown by phantom lines in FIG. 4. The upper jaw 82 of clamping means 80 is lowered as seen in FIG. 5 to grasp the accumulated sheets 1 which will be bound into document 200. The stitching means 90, which typically can be an Interlake Stitchhead Model 86177F, is activated to place the first stitch (staple) in the document. After the first stitch is placed in the document, a new signal is generated by the microprocessor to advance the document in car 52 to the position where the second stitch is placed. Obviously, any number of stitches can be placed in the document, three stitches being shown by stitch marks 3 in FIG. 7.

After the last stitch is placed in the document, a new series of signals are generated by the microprocessor. The car 52 is moved downstream for further downstream processing operations. When car 52 has cleared stop elements 58, a signal from the microprocessor is generated to elevate tray member 62 to a small angle from its original horizontal plane. Simultaneously, a second signal from the microprocessor starts the feed of sheets 1 which will be bound into the next document. These sheets are fed onto tray member 62 and stopped by stop members 58. Thus, sheets for the next document are being accumulated while car 52 is away from its home position.

The car 52 moves at a preselected steady speed until it is stopped by the forward edges of the assembled document contacting stop element 122 in the second clamping means 120. At this time, clamping means 120 is in its first (forward) position as shown in FIG. 3. This contact generates a signal which lowers the upper jaw 124 of the clamping means 120. The assembled document 200 is grasped by jaws 124 and 121 in an area essentially coextensive with recess 54 in car 52.

Another signal is generated to open jaw 82 of the first clamping means 80 and to return car 52 to its home position. An additional signal opens jaw 124 and retracts second clamping means 120 to its second (rearward) position shown in FIG. 4. This action causes the finished document 200 to fall by gravity onto a stack of documents being collected on a horizontal support platform 130 having a slot 132 cut therein. Slot 132 has a width which extends slightly beyond the outer edges of conveyor belt 150. See FIG. 4. Platform 130 is supported by fingers 134 which ride in supporting channels 136. See FIG. 5. As each document is placed on the stack, platform 130 is lowered a preselected distance.

After a preselected number of documents are collected on platform 130, a signal is generated to stop the feed of sheets 1 and to keep car 52 in its home position. This signal also actuates a motor (not shown) to move door 170 to its open position shown by phantom lines in FIG. 1. When door 70 is fully opened, another signal lowers platform 130 to its bottommost position and starts a motor which drives conveyor belt 150. Belt 150 delivers the stacked document to the support shelf 18 provided in housing 14. When the document stack is delivered to the position shown in FIG. 5, signals are generated which stop conveyor belt 150, close door 170 and raise platform 130 to its topmost position. At this time, another signal begins sheet feed to the apparatus to start a new cycle as described above.

The apparatus shown in the drawings includes optional features to provide versatility. As seen in FIG. 4, a diverting finger 42 is provided. In its normal position, shown in solid lines, finger 42 performs no function. When lowered into its second position, shown by phantom lines in FIG. 4, finger 42 diverts the sheets into a slanting tray 43. Lip 44 prevents the sheets from falling out of tray 42. In still another option, suitable holes may be punched in the vertical margin of sheets 1 as they pass through a high speed punching element 40. The assembly of sheets collected in tray 43 are removed manually for transfer to other types of finishing operations.

In the drawings, the documents are shown as being stitched in their left-hand margin. In preparing such documents, the sheets will be fed through the apparatus with their image (printed) surface face up.

While the methods herein described and the forms of apparatus for carrying these methods into effect constitute preferred embodiments of this invention, it is to be understood that the invention is not limited to these precise methods and forms of apparatus, and that changes may be made in either without departing from the scope of the invention which is defined in the appended claims.

What is claimed is:

1. Apparatus for preparing a multipage, side-stitched document which comprises in combination:

(a) means for feeding a series of sheets to be included in said document in a paused, timed, preselected order;

(b) a downstream, in-line accumulating station to receive the sheets;

(c) first clamping means associated with the accumulating station for grasping a complete assembly of sheets on the side opposite the side to be stitched;

(d) means for moving said clamped assembly to a downstream, in-line stitching station;

(e) said stitching station including a stitching head to make two or more stitches in the assembled sheets at selected loci along their edge;

(f) means for moving the stitched assembly downstream from the stitching station;

(g) stop means downstream of the stitching station to stop movement of the side-stitched document;

(h) second clamping means associated with said stop means for grasping the document on its upstream side transverse to the stitched side;

(i) means for releasing the first clamping means from the document and returning said clamping means to the accumulating station; and (j) means for releasing the second clamping means and transferring the side-stitched document to a packing station.

2. The apparatus of claim 1 in which the accumulating station includes:

(i) a rearwardly positioned nonmovable element including forwardly facing fingers, said element being hinged so that it can be elevated at a small angle from its normally occupied horizontal plane so that its fingers point slightly upwardly;

(ii) a movable main body element including rearwardly facing fingers which intermesh with the fingers of the nonmovable element of (i), said main body element carrying the first clamping means of the apparatus; and (iii) stop means which alternately occupy two vertically disposed positions and which, in its lower position, stops sheets being fed into the accumulating station when the movable main body element is in its home position and which, in its upper position, stops sheets being fed into the elevated nonmovable element.

3. The apparatus of claim 2 in which the means for transferring the side-stitched document to a packaging station is an elevator positioned directly below the space occupied by the document when held by the second clamping means.

4. The apparatus of claim 3 in which the elevator includes a transverse slot in its face which is aligned with a conveyor belt to transfer a stack of documents from said elevator to a receiving station.

5. The apparatus of claim 1 in which the means for transferring the side-stitched document to a packaging station is an elevator positioned directly below the space occupied by the document when held by the second clamping means.

6. The apparatus of claim 5 in which the elevator includes a transverse slot in its face which is aligned with a conveyor belt to transfer a stack of documents from said elevator to a receiving station.

7. The apparatus of claim 1 in which the stitching station includes a single stitching head and means for temporarily stopping movement of the assembled sheets at preselected positions in the stitching station so that two or more stitches can be made at selected loci along the edge of the document.

8. Apparatus for producing a multipage, side-stitched document comprising:

(a) accumulator means for receiving imaged sheets of paper and collecting them into a stack;

(b) means defining a stapling station displaced from said accumulator means in a direction parallel to one edge of said stack;

(c) transport means for transporting said stack in said direction and causing different portions of said stack to pass successivley through said stapling station;

(d) clamping means for clamping said sheets together during transporting of said stack by said transport means; and (e) stapling means for driving staples through said different portions of said stack as they are presented to said stapling stations; said accumulator means including:

(i) a rearwardly positioned nonmovable element including forwardly facing fingers, said element being hinged so that it can be elevated at a small angle from its normally occupied horizontal plane so that its fingers point slighly upwardly;

(ii) a movable main body element including rearwardly facing fingers which intermesh with the fingers of the nonmovable element of (i), said main body element carrying the clamping means of the apparatus; and (iii) stop means which alternately occupy two vertically disposed positions and which, in its lower position, stops sheets being fed into the accumulator means when the movable main body element is in its home position and which, in its upper position, stops sheets being fed into the elevated nonmovable element.

9. Appoaratus of claim 8 in which the clamping means are attached to the accumulator means.

10. A process for preparing a multipage, side-stitched document which comprises:

(a) feeding each of the pages to be included in the document in a paused, timed, preselected order to an accumulating station and preparing an assembly of juxtapositioned sheets to be included in the document;

(b) grasping a complete assembly of pages with first clamping means on the side opposite the side to be stitched;

(c) moving the assembly to a downstream, in-line stitching station;

(d) stitching the assembly at two or more loci along the assembly adjacent the edge;

(e) moving the side-stitched document to a downstream, in-line grasping station;

(f) grasping the document with second clamping means on a side downstream of and transverse to the stitched side;

(g) removing the first clamping means from the document and returning it to the accumulating station;

(h) removing the second clamping means from the document; and (i) moving the document to a packing station, said process being further characterized in that:

(j) the time interval for moving the clamped page assembly from the accumulating station to the grasping station and returning the first clamping means to the accumulating station is less than the time interval for accumulating a complete assembly of pages in the accumulating station; and (k) the time interval for moving the clamped document from the grasping station to the packing station and returning the second clamping means to the grasping station is less than the time interval for accumulating a complete assembly of pages in the accumulating station.

* * * * *

UNITED STATES PATENT AND TRADEMARK OFFICE

CERTIFICATE OF CORRECTION

PATENT NO. : 4,575,296

DATED : MARCH 11, 1986

INVENTOR(S) : Barry C. Kockler et al.

It is certified that error appears in the above-identified patent and that said Letters Patent is hereby corrected as shown below:

Claim 8, Col. 5, line 28, "successivley" should be --successively--.

Claim 8, Col. 5, line 41, "slighly" should be --slightly--.

Claim 9, Col. 6, line 7, "Appoaratus" should be --Apparatus--.

Signed and Sealed this

*First* Day of *July 1986*

[SEAL]

*Attest:*

DONALD J. QUIGG

*Attesting Officer*

*Commissioner of Patents and Trademarks*